US006393983B1

(12) United States Patent
Iijima et al.

(10) Patent No.: US 6,393,983 B1
(45) Date of Patent: May 28, 2002

(54) INK RAIL FOR PRINTING PRESS

(75) Inventors: Takashi Iijima, Yokosuka; Hiroji Yoshida, Kawasaki; Yoshio Kobayashi, Tokyo, all of (JP)

(73) Assignee: Kabushiki Kaisha Tokyo Kikai Seisakusho, Tokyo (JP)

( * ) Notice: Subject to any disclaimer, the term of this patent is extended or adjusted under 35 U.S.C. 154(b) by 0 days.

(21) Appl. No.: 09/571,380

(22) Filed: May 15, 2000

(30) Foreign Application Priority Data

Oct. 21, 1999 (JP) ..... 11-299776

(51) Int. Cl.[7] ..... B41F 31/00

(52) U.S. Cl. ..... 101/351.08; 101/352.01; 101/367

(58) Field of Search ..... 101/350.1, 350.6, 101/351.8, 365, 366, 352.04, 352.01

(56) References Cited

U.S. PATENT DOCUMENTS 3,566,787 A * 3/1971 Moos ..... 101/363
3,645,202 A * 2/1972 Lake ..... 101/148
4,901,641 A * 2/1990 Steiner et al. ..... 101/152
5,406,887 A * 4/1995 Hertel et al. ..... 101/366
5,832,828 A * 11/1998 Marmin et al. ..... 101/350.1
6,213,017 B1 * 4/2001 Schafer et al. ..... 101/352.01
6,247,402 B1 * 6/2001 Iijima et al. ..... 101/365

FOREIGN PATENT DOCUMENTS

JP 1-229633 9/1989

* cited by examiner

*Primary Examiner*—Eugene Eickholt
(74) *Attorney, Agent, or Firm*—Foley & Lardner

(57) ABSTRACT

An ink rail for a printing press has an ink rail body, a pedestal, a supporting member and a distance adjusting means. The ink rail body has a concave curved surface and also has an ink supplying surface having plural ink supplying ports opened to the concave curved surface. The pedestal supports the ink rail body in a supporting plane parallel to the joining face of the ink rail body. The supporting member supports the pedestal so as to be angularly displaced. The ink rail body can be reciprocated along the supporting plane of the pedestal. The joining face of the ink rail body approximately conforms to a plane including a rotation central line of the fountain roller, and the concave curved surface of the ink rail body can be approached and separated from the outer circumferential surface of the fountain roller.

11 Claims, 4 Drawing Sheets

INK RAIL FOR PRINTING PRESS

BACKGROUND OF THE INVENTION

1. Field of the Invention

This invention relates to an ink rail for supplying inks to a fountain roller from an ink supplying surface opposed to an outer circumferential surface of the fountain roller in an ink supplying device of a printing press.

2. Description of the Background Art

Many ink rails of an ink supplying device are conventionally known as shown in Japanese Patent Laid-Open Publication No. 1-229633 prior art 1), etc. Namely, an ink rail body of an ink rail is opposed to an outer circumferential surface of a fountain roller so as to cover the outer circumferential surface. An ink supplying surface that has a concave curved surface for supplying ink and has a relatively long arc is formed along the outer circumferential surface of the fountain roller. An ink supplying pipe is normally connected to the ink rail body and extends from an ink pump for supplying the ink to a side opposed to the ink supplying surface which is a concave curved face. An ink supplying port is opened to an ink supplying surface side. An ink guide path for connecting the ink supplying pipe and the ink supplying port is arranged between the ink supplying pipe and the ink supplying port.

The ink sent out by the ink pump reaches the ink supplying port through the ink guide path, and is transferred onto the outer circumferential surface of the fountain roller. The ink is further transferred to a roller arranged downstream in contact with the fountain roller by rotating the fountain roller.

The ink rail s constructed such that the ink supplying surface can be separated from the outer circumferential surface of the fountain roller to clean the ink supplying surface, etc. Namely, a supporting member is supported by bearings arranged in both end portions in a longitudinal direction of the supporting member and has an eccentric structure capable of being angularly displaced. An adjusting guide face highly inclined on a side close to the fountain roller is formed in a pedestal arranged in the supporting member, and the ink rail body is arranged such that the ink rail body can be moved and adjusted along this inclination. This device is constructed such that the ink supplying surface arranged in the ink rail body can be opposed to the outer circumferential surface of the fountain roller at a suitable distance in an operating position, and can be selectively located between the operating position in proximity to the fountain roller and an unoperating position separated from the outer circumferential surface of the fountain roller.

The distance between the ink supplying surface of the ink rail body and the outer circumferential surface of the fountain roller is adjusted by separately moving a supporting position of the supporting member leftward and rightward. The supporting position of the supporting member is moved by approaching and separating the ink rail body attached to the inclined adjusting guide face of the pedestal arranged in the supporting member with respect to the outer circumferential surface of the fountain, roller, and individually angularly displacing the bearings of the eccentric structure arranged in both the end portions of the supporting member.

In the ink rail disclosed in the prior art 1, the ink can be supplied over the entire width of a printing face in a printing press capable of printing the ink to wide web paper. The length of an arc of the ink supplying surface of the ink rail body is relatively long and the mass of the ink rail body is increased to give rigidity to the ink rail body, causing operability to be poor and increasing the associated cost.

When the printing press is used for a long time, the ink rail body is flexed in a vertical direction by a change in dead weight of the ink rail body while in an operating position. Further, the ink rail body is flexed by the influence of a pressure caused by the ink existing within the distance formed between the ink supplying surface and the outer circumferential surface of the fountain roller during the operation of the printing press such that the ink rail body is separated from the outer circumferential surface of the fountain roller. With respect to the tiny distance to be suitably set and maintained between the outer circumferential surface of the fountain roller and the ink supplying surface of the ink rail body having a relatively long arc, a distance near an end portion of the ink rail in its longitudinal direction and a distance near a central portion and its peripheral portion are different from each other due to the flexure. As a result, a problem exists in that the ink supply becomes unstable and printing quality is reduced.

Further, the distance is adjusted by a complicated construction in which the ink rail body having the ink supplying surface constructed by a long concave curved surface having the relatively long arc is moved on an adjusting guide surface and angular displacement centers of eccentric bearings arranged in both end portions of a supporting member are individually moved. Accordingly, upper and lower ends of the arc of the ink supplying surface in its longitudinal direction can easily come in contact with the outer circumferential surface of the fountain roller during adjustment operations. Therefore, a problem exists in that great skill is required to adjust the distance, and the flexure problem still persists.

Further, in a worst case, there is a possibility of mutual damage caused by operating the printing press while the ink supplying surface of the ink rail body comes in contact with the outer circumferential surface of the fountain roller.

To prevent occurrences of these problems, the supporting member and the flexed ink rail body are detached, reprocessed and replaced with new parts and attachments of the respective members are readjusted and reassembled, etc. so that large repair countermeasures are required. In addition to this, when the ink rail body is assembled into the supporting member, it is difficult to determine a reference position of the ink rail body and skill is required in working of this determination so that it takes much time to make this work.

SUMMARY OF THE INVENTION

To solve the above problems, the present invention proposes an ink rail for a printing press capable of selecting an operating position in proximity to an outer circumferential surface of a fountain roller and an nonoperating position separated from the outer circumferential surface of the fountain roller;

the ink rail comprising:

an ink rail body formed by joining at least two members on a joining face so as to be divided and having a concave curved surface formed over at least the two members and having plural ink supplying ports opened to the concave curved surface along one joining face predetermined in advance;

a pedestal for supporting the ink rail body in a supporting plane parallel to the joining face having the ink supplying ports of the ink rail body;

a supporting member for supporting the pedestal so as to be angularly displaced; and distance adjusting means arranged such that the ink rail body can be reciprocated along the supporting plane of the pedestal in a direction perpendicular to a longitudinal direction of the ink rail body;

the ink rail being constructed such that the joining face of the ink rail body approximately conforms to a plane including a rotation central line of the fountain roller in the operating position, and the concave curved surface of the ink rail body can be approached and separated from the outer circumferential surface of the fountain roller so as to adjust the distance therebetween.

The present invention also proposes an ink rail for a printing press capable of selecting an operating position in proximity to an outer circumferential surface of a fountain roller and an unoperating position separated from the outer circumferential surface of the fountain roller;

the ink rail comprising:

an ink rail body formed by joining at least two members approximately formed in the shape of a rectangular parallelepiped plate on a joining face so as to be divided and having a concave curved surface formed over at least the two members and having plural ink supplying ports opened to the concave curved surface along one joining face predetermined in advance;

a pedestal for supporting the ink rail body in a supporting plane parallel to the joining face having the ink supplying ports of the ink rail body;

a supporting member for supporting the pedestal so as to be angularly displaced; and distance adjusting means arranged such that the ink rail body can be reciprocated along the supporting plane of the pedestal in a direction perpendicular to a longitudinal direction of the ink rail body;

the ink rail being constructed such that the joining face of the ink rail body having the ink supplying surface approximately conforms to a plane including a rotation central line of the fountain roller in the operating position, and the concave curved surface of the ink rail body can be approached and separated from the outer circumferential surface of the fountain roller so as to adjust the distance therebetween.

In addition to the above two ink rails for the printing press, the present invention also proposes an ink rail for the printing press in which the concave curved surface of the ink rail body has a size corresponding to a size from 1/12 to 1/6 times that of the outer circumferential surface of the fountain roller in its circumferential direction.

In addition to the above three ink rails for the printing press, the present invention also proposes an ink rail for the printing press in which the supporting plane of the pedestal for supporting the ink rail body in the supporting plane parallel to the joining face of the ink rail body is horizontal.

In addition to the above four ink rails for the printing press, the present invention further proposes an ink rail for the printing press in which the ink rail body is divided into plural bodies in a longitudinal direction of the fountain roller and the distance adjusting means is arranged every divided ink rail body and the divided ink rail bodies can be individually adjustably approached and separated from the outer circumferential surface of the fountain roller.

DESCRIPTION OF THE PREFERRED EMBODIMENTS

Figure 1:
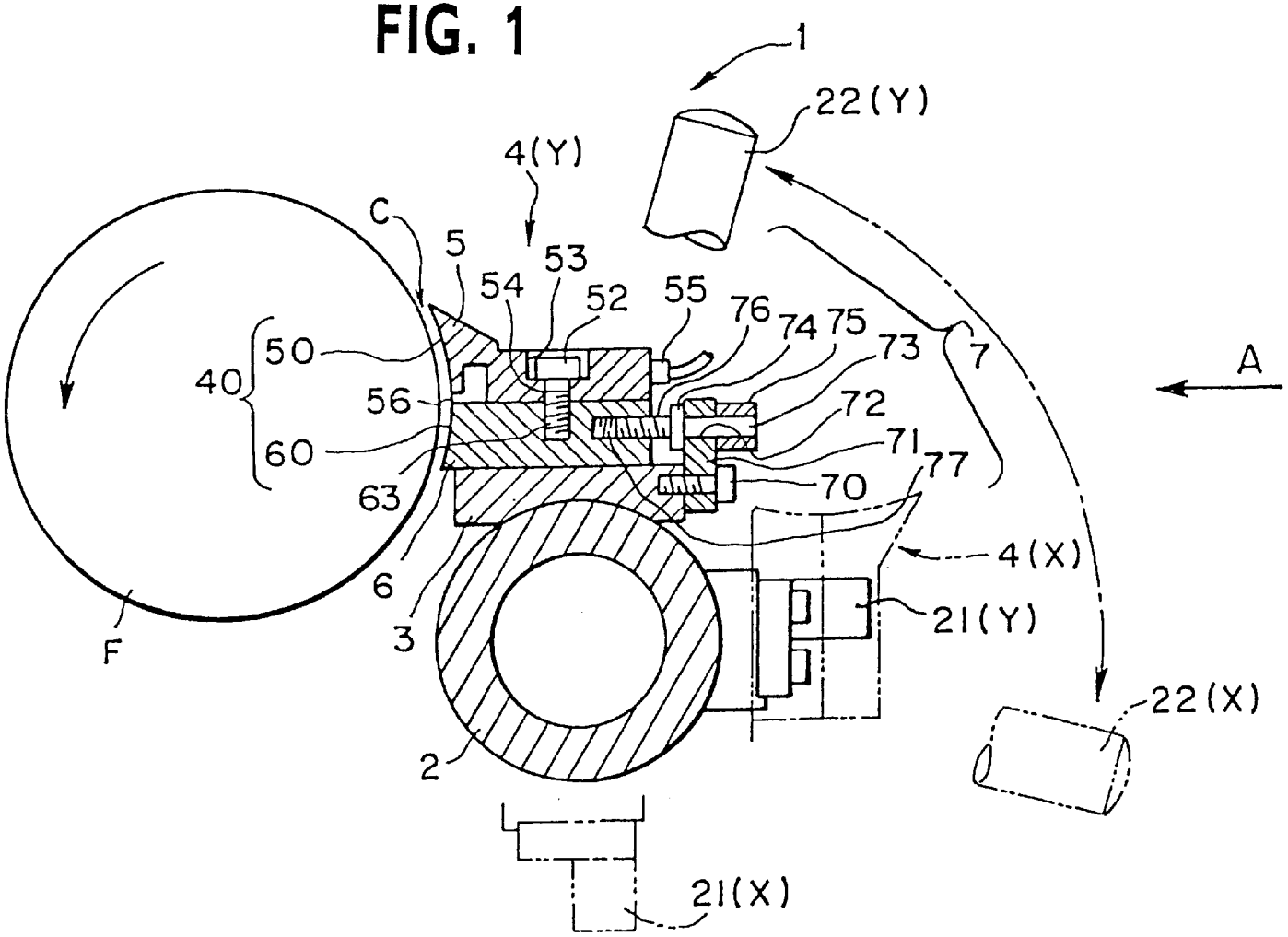
FIG. 1 is a transversal sectional view of an ink rail in a state in which first and second adjusting means of the ink rail common to the first and second embodiment modes of the ink rail for a printing press in this invention are located in an operating position Y.
Figure 2:
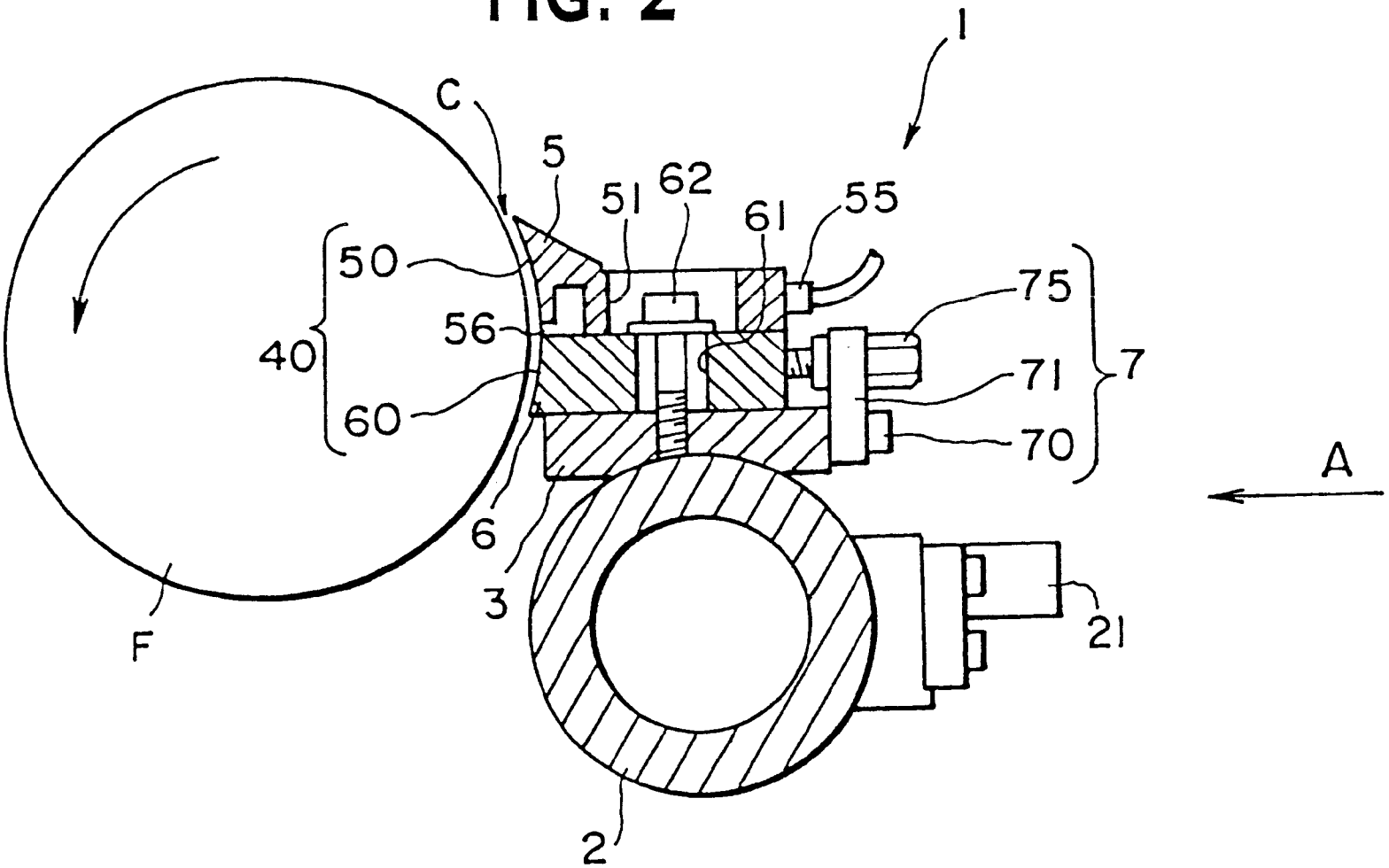
FIG. 2 is a sectional view of the ink rail in a state in which a bolt, etc. in each distance adjusting means of the ink rail common to the first and second embodiment modes are similarly located in the operating position.
Figure 3:
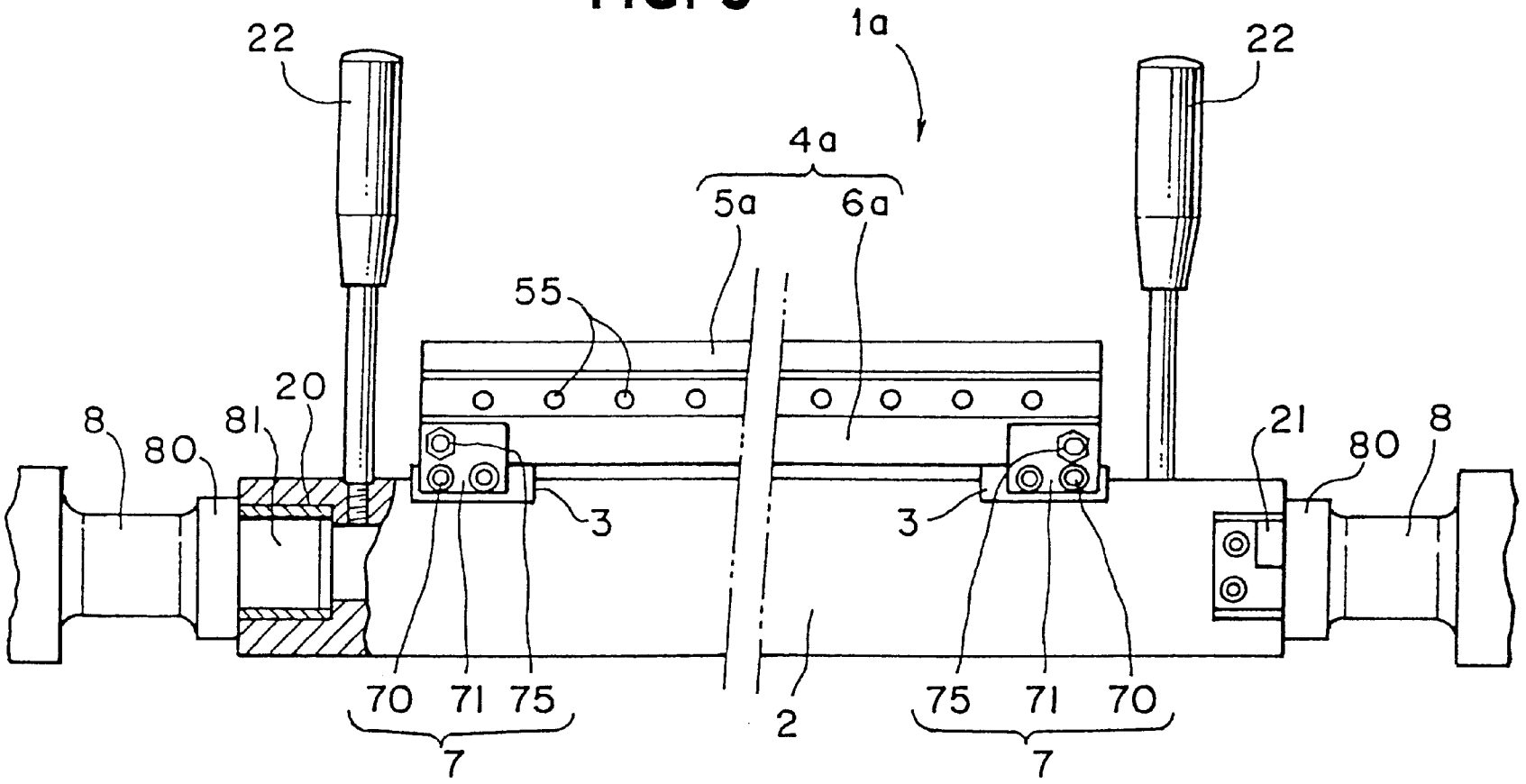
FIG. 3 is a view as seen along arrow A of each of FIGS. 1 and 2 of the ink rail in the first embodiment mode of this invention.
Figure 4:
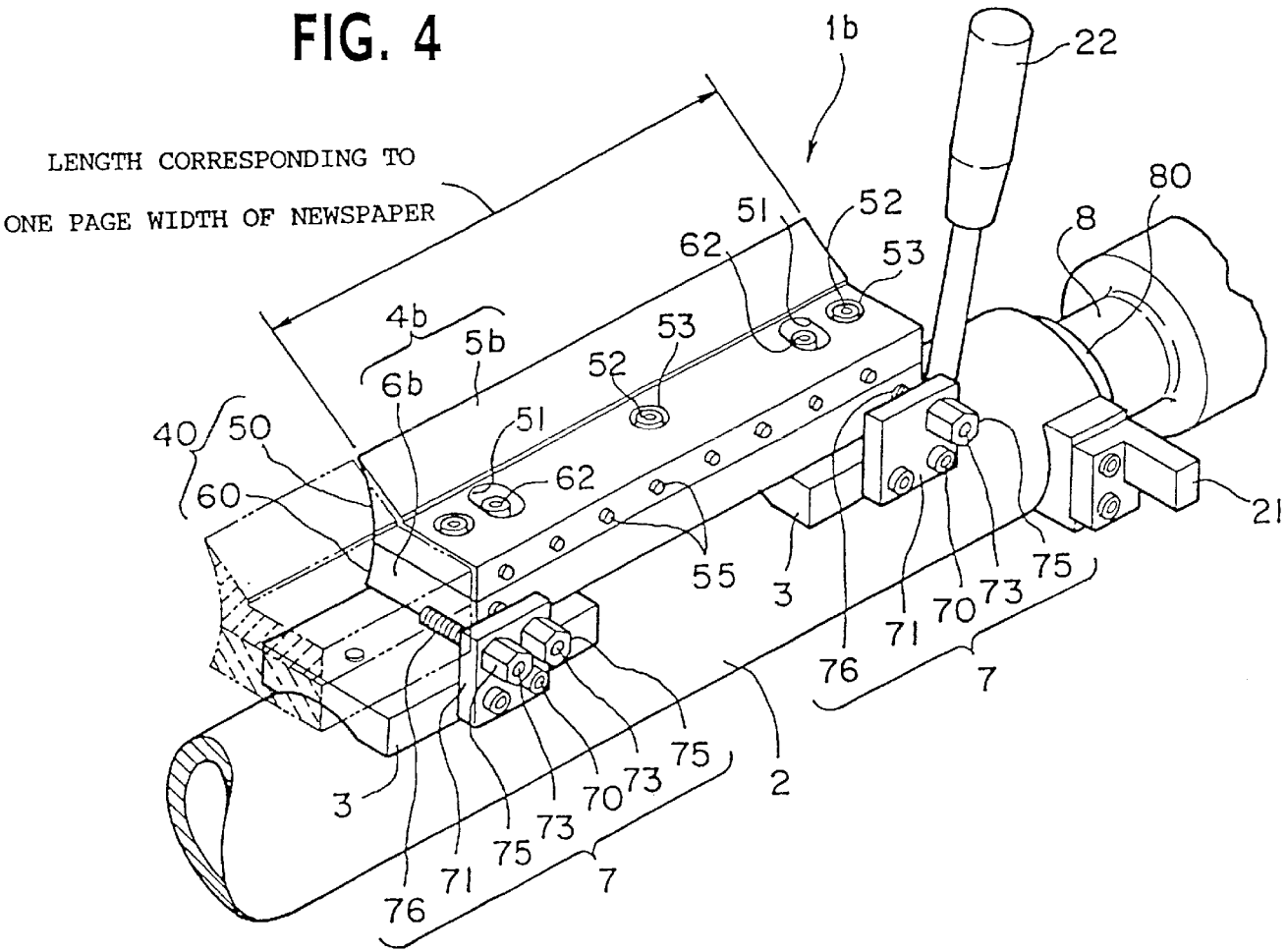
FIG. 4 is a partial perspective isometric view of the second embodiment mode of the invention in which the ink rail formed by dividing an ink rail body into portions of a length corresponding to one page width of a newspaper and connecting the divided ink rail body portions to each other.

FIG. 1 is a transversal sectional view showing a distance adjusting means of an ink rail in an operating position common to first and second embodiment modes of the invention. FIG. 2 is a sectional view of the ink rail showing a bolt, etc. in the distance adjusting means of the ink rail in an operating position common to both the first and second embodiment modes. FIG. 3 is a view taken along arrow A of each of FIGS. 1 and 2 of the ink rail in the first embodiment mode of this invention. FIG. 4 is a partial perspective view in which the ink rail formed by dividing an ink rail body of the second embodiment mode of this invention into portions and connecting the divided ink rail body portions to each other. The present invention will next be explained on the basis of FIGS. 1 to 4.

An ink rail 1*a* of the first embodiment mode of this invention and an ink rail 1*b* of the second embodiment mode have a supporting member 2, a pedestal 3, an ink rail body 4 (4*a*, 4*b*) formed by joining a first member 5 and a second member 6 to each other, and a distance adjusting means 7.

The ink rail 1*a* of the first embodiment mode of this invention has an elongated integral ink rail body 4*a* approximately formed in the shape of a rectangular parallelepiped plate such that each of the first member 5*a* and the second member 6*a* extends in the longitudinal direction of a fountain roller F. This ink rail body 4*a* can be moved with respect to an outer circumferential surface of the fountain roller F.

The ink rail 1b of the second embodiment mode of this invention has an ink rail body 4*b* approximately formed in the shape of a rectangular parallelepiped plate such that each of the first member 5*b* and the second member 6*b* is divided into plural portions in a longitudinal direction of the supporting member 2 along the longitudinal direction of the fountain roller F. These plural divided ink rail bodies 4*b* can be individually moved with respect to the outer circumferential surface of the fountain roller F.

A construction common to the ink rail 1*a* in the first embodiment mode of this invention and the ink rail 1*b* in the second embodiment mode will be explained. The supporting member 2 is compact and light in weight and has sufficient rigidity and is approximately formed in a cylindrical shape. The supporting member 2 is attached to unillustrated frames on both sides through a bracket 8. The supporting member 2 is parallel to the longitudinal direction of the fountain roller F and is longer than the face length of the fountain roller F. A bearing 20 is arranged in each of both end portions of the supporting member 2 and is attached to a shaft portion 81 through a flange 80 of the bracket 8. The supporting member 2 is restricted in its longitudinal direction and can be angularly displaced with respect to the fountain roller F.

An angular displacement limiting member 21(Y) for positioning the ink rail body 4 (4*a*, 4*b*) in an operating position is arranged in the vicinity of each of both the end portions of the supporting member 2. One side end face of the angular displacement limiting member 21(Y) is fixed in a state in which an upper face of this one side end face hits against an unillustrated angular displacement limiting portion arranged in the frame. Thus, the ink rail body 4 is positioned in the operating position Y.

When the ink rail body 4 is separated from the outer circumferential surface of the fountain roller F and is moved to an unoperating position X so as to perform a cleaning operation of an ink supplying surface 40 (50, 60) of the ink rail body 4 and maintenance, etc., the other side end face of an angular displacement limiting member 21(X) hits against an unillustrated stopper arranged in the frame so that the angular displacement limiting member 21(X) limits the unoperating position.

In the embodiment mode shown in FIGS. 1 and 2, an upper face of the pedestal 3 is horizontally set by making one side end face of the angular displacement limiting member 21(Y) hit against an unillustrated angular displacement limiting portion in the operating position Y of each of the ink rails 1*a*, 1*b*.

An operating lever 22 is arranged in the vicinity of each of both the end portions of the supporting member 2 (see FIG. 3). The ink rail body 4 can be easily moved between the operating position Y and the nonoperating position X by angularly displacing the supporting member 2 with respect to the fountain roller F by operating the operating lever 22.

In the embodiment mode shown in FIGS. 3 and 4, the pedestal 3 is integrally fixed to the supporting member 2 in a suitable position including positions near both the end portions of the supporting member 2 in its longitudinal direction. In another embodiment mode, it is not necessary to integrally fix the pedestal 3 to the supporting member 2 near both the end portions of the supporting member 2. One or more suitable number of pedestals 3 are arranged in the longitudinal direction of the supporting member 2. A length and a width of the pedestal 3 are suitably set.

In the embodiment mode shown in FIGS. 1 and 2, joining faces having an ink supplying port 56 of the ink rail body 4 constructed by the first member 5 and the second member 6 are joined to each other by a bolt 52 so that the ink rail body 4 is set to an integral structure. The ink supplying port 56 opened to the ink supplying surface 40 is nipped and formed between the joining faces of the first member 5 and the second member 6. When the ink rail body 4 is attached to the horizontal upper face of the pedestal 3 in the operating position Y, the thickness of the second member 6 of the ink rail body 4 is determined in advance such that an upper face of the second member 6 as one joining face conforms to a plane including the rotating center of the fountain roller F.

In the operating position Y in the embodiment mode of this invention, the ink supplying surface 50 of the first member 5 has a projecting portion extending along the outer circumferential surface of the fountain roller F with respect to flexure due to an influence of empty weight of the ink rail body 4. Further, the ink rail body 4 having a thickness of two stuck sheets as an integral structure formed by joining the first member 5 and the second member 6 by the bolt is supported by a sectional action of the approximately cylindrical shape of the supporting member 2 and effectively restrains the flexure.

On the other hand, the ink rail body 4 tends to be separated from the outer circumferential surface of the fountain roller F by the influence of a pressure caused by ink existing within a distance C formed between the ink supplying surface 40 (50, 60) and the outer circumferential surface of the fountain roller F during the press operation. With respect to flexure due to this separation, the ink rail body 4 has a rectangular section extending in a direction perpendicular to the longitudinal direction of the fountain roller F, and effectively restrains this flexure by the sectional action of the approximately cylindrical shape of the supporting member 2.

The ink rail body 4 integrally constructed by joining the joining faces formed in the ink supplying port 56 by the bolt 52 can be disjointed and divided into two portions composed of the first member 5 and the second member 6. When the ink rail body 4 is reassembled, the first and second members can be reassembled since relative positions of the first and second members are known at any time by an unillustrated positioning member such as plural positioning pins. Accordingly, the ink rail body 4 divided into the first member 5 and the second member 6 is easily disjointed and assembled.

Upper and lower faces of the second member 6 are set to be parallel to each other. Further, the upper face of the second member 6, i.e., a joining face formed in the ink supplying port 56 is set to be in conformity with a plane including a rotation central line of the fountain roller F at any time. Thus, the ink supplying port 56 opened to the ink supplying surface 40 is nipped between the first member 5 having the ink supplying surface 50 opposed to the outer circumferential surface of the fountain roller F and the second member 6 having the ink supplying surface 60, and is opposed to the outer circumferential surface of the fountain roller F and is also opposed to this rotation central line at any time.

The ink supplying surface 40 is a concave curved surface constructed by a concentric circle having a radius equal to or extremely slightly greater than that of the fountain roller F, or an arc close to this concentric circle in a state in which the rotation central line of the fountain roller F for conforming the upper face of the second member 6 to an extending plane is set to a center.

In the operating position Y, a small adjustable distance C suitably set is formed between the ink supplying surface 40 and the outer circumferential surface of the fountain roller F. Plural ink supplying ports 56 nipped and formed by the first member 5 and the second member 6 are opened to the ink supplying surface 40. Ink sent from an unillustrated ink supplying portion through plural ink supplying pipes 55 respectively corresponding to the plural ink supplying ports 56 is supplied to the outer circumferential surface of the fountain roller F. A length of the arc of the concave curved surface of the ink supplying surface 40 in each of the embodiment modes of this invention is approximately set to an arc length in a range from 1/12 to 1/6 times a circumferential length of the fountain roller F.

The ink rail body 4*a* of the first embodiment mode shown in FIG. 3 is constructed by the first member 5*a* and the second member 6*a*. The ink rail body 4*a* is adjustably attached to the upper face of the pedestal 3 and is horizontally arranged in the operating position Y. The ink rail body 4*a* has a length slightly shorter than the unillustrated face length of the fountain roller F in its longitudinal direction when it is in the same direction as the longitudinal direction of the supporting member 2, and is approximately formed in the shape of a rectangular parallelepiped plate.

The ink rail body 4*b* of the second embodiment mode shown in FIG. 4 is constructed by the first member 5*b* and the second member 6*b*. The ink rail body 4*b* is individually adjustably attached to the upper face of the pedestal 3 and is horizontally arranged in the operating position Y. The ink rail body 4*b* has a suitable width in the longitudinal direction of the supporting member 2, e.g., a length corresponding to that of one page unit of a newspaper. The ink rail body 4*b* is approximately formed in the shape of a rectangular parallelepiped plate in which the ink rail body 4*b* divided into plural portions and these divided portions are arranged in parallel with each other and are connected to each other.

Each of these ink rail bodies 4 (4*a*, 4*b*) is arranged on the upper face of the pedestal 3 such that the ink supplying surface 40 (50, 60) can be adjusted, approached, and separated from the side opposite to the outer circumferential surface of the fountain roller F.

In the embodiment mode shown in FIGS. 1 and 2, plural counterbore holes 53 and plural bolt holes 54 are formed in the first member 5 and plural female screws 63 are formed in the second member 6 in the ink rail body 4. Each of the counterbore holes 53 extends from an upper face to a lower face of the ink rail body 4 along the longitudinal direction of the fountain roller F. Each of the bolt holes 54 extends through the ink rail body 4 until its lower face. The first member 5 and the second member 6 are joined and integrated with each other by plural bolts 52. An unillustrated ink passage is formed on a joining face of the first member 5 and the second member 6 and is continuously connected to the plural ink supplying ports 56 for supplying the ink to the outer circumferential surface of the fountain roller F.

In the operating position Y, the ink rail body 4 is attached to the upper face of the pedestal 3 by a bolt 62 such that the ink supplying surface 40 is opposed to the outer circumferential surface of the fountain roller F and, during adjustments is approached and separated from the outer circumferential surface of the fountain roller F by a distance adjusting means 7. Plural elongated bolt holes 61 are formed in parallel with each other in the second member 6 in the longitudinal direction of the fountain roller F. An elongated bolt hole 51 for storing a head portion of the bolt 62 extends through the first member 5 from its upper face to a lower face of this first member 5. An elongated bolt hole 61 inserting the male screw portion of the bolt 62 thereinto extends through the second member member 6 from its upper face to the lower face of the second member 6. These elongated bolt holes 51, 61 extend in a direction perpendicular to the longitudinal direction of the supporting member 2. A diameter of the elongated bolt hole 51 is larger than at least diameters of the head portion of the bolt and its washer. A diameter of the elongated bolt hole 61 is larger than at least the diameter of a male screw of the bolt 62. The lengths of the elongated bolt holes 51, 61 are set to lengths required to suitably adjust and set the distance C between the outer circumferential surface of the fountain roller F and the ink supplying surface 40 of the ink rail body 4.

The distance adjusting means 7 horizontally moves the lower face of the second member 6 of the ink rail body 4 in a transversal direction of the ink rail body 4 along the upper face of the pedestal 3. In the embodiment mode of this invention, the distance adjusting means 7 has an adjusting shaft holding member 71, an adjusting shaft guide hole 72, an adjusting shaft 73, a flange 74, an adjusting member 75 and a male screw 76. The adjusting shaft holding member 71 is attached to a rear end face of the pedestal 3 on an side opposed to a side of the fountain roller F by a bolt 70. The adjusting shaft guide hole 72 extends through the adjusting shaft holding member 71 in a direction approximately perpendicular to a flat face of this adjusting shaft holding member 71. The adjusting shaft 73 is inserted into the adjusting shaft guide hole 72. The flange 74 is arranged on a side of the adjusting shaft 73 near the second member 6 so as to nip the adjusting shaft holding member 71. The adjusting member 75 rotates the adjusting shaft 73 integrally with this adjusting shaft 73 on a side opposed to the flange 74 through the adjusting shaft holding member 71. The male screw 76 is arranged on an extension line of the adjusting shaft 73 on its side of the second member 6. The male screw 76 of the distance adjusting means 7 is screwed into a female screw 77 formed on a rear end face of the second member 6 toward a transversal direction of the second member 6.

In the second embodiment of this invention shown in FIG. 4, the ink rail is used in a newspaper printing press capable of printing web paper having a four-page width of a newspaper. One pair corresponds to one page width of the newspaper and the ink rail body 4*b* is constructed by the first member 5*b* and the second member 6*b* divided into four pairs. The ink rail body 4*b* is individually moved by operating the distance adjusting means 7. Thus, it is possible to individually adjust the distance C between the ink supplying surface 40 and the outer circumferential surface of the fountain roller F.

An attaching work of the ink rail body 40 in the embodiment mode of this invention is made by the following procedure. The angular displacement limiting member 21 (Y) arranged in an end portion of the supporting member 2 hits against an unillustrated angular displacement limiting portion in the operating position Y, and its position is adjusted. For example, the upper face of the pedestal 3 is horizontally set in advance. The angular displacement limiting member 21 is then fixed to the angular displacement limiting portion. The ink rail body 4 is next attached to the upper face of the pedestal 3 and is horizontally set. The distance adjusting means 7 is attached onto rear end face sides of the pedestal 3 and the second member 6 on a side opposed to a side of the fountain roller F. Next, the ink rail body 4 is fixed to the pedestal 3 by reliably fastening the bolt 62.

An operation of the ink rail in this invention will next be explained. The ink rail 1 in the nonoperating position X shown by a two-dotted chain line in FIG. 1 is angularly displaced until the operating position Y shown by a solid line by angularly displacing the operating lever 22(X). Namely, the ink rail body 4 constructed by the first member 5 and the second member 6 is angularly displaced together with the supporting member 2 and the pedestal 3 to the operating position Y shown by a solid line from the nonoperating position X shown by a two-dotted chain line of FIG. 1 and is stopped by angularly displacing the operating lever 22 from the X-position to the Y-position.

When this operating lever 22(X) is angularly displaced to the operating position Y, the angular displacement limiting member 21(Y) hits against an unillustrated angular displacement limiting portion which has already been set. Therefore, if a suitable distance is formed between the ink rail body 4 and the fountain roller F at the time of an attaching work, the ink supplying surface 40 of the ink rail body 4(Y) will not hit against the outer circumferential surface of the fountain roller F.

A distance adjusting operation using the distance adjusting means 7 is performed by the following procedure in consideration of the tip of the arc of the concave curved surface of each of first member 5. In the state of the operating position Y, the second member 6 attached to the upper face of the pedestal 3 is also horizontally set as shown in FIGS. 1 and 2, and the ink supplying port 56 with respect to the ink supplying surface 40 is opposed to the rotational central line of the fountain roller F at all time. In this state, the distance C between the outer circumferential surface of the fountain roller F and the ink supplying surface 40 is adjusted. The bolt 62 of the second member 6 is slightly loosened so that the second member 6 can be moved by the length of the elongated bolt hole 61 in its longitudinal direction along the upper face of the pedestal 3.

Next, the ink rail body 4 is advanced or retreated by rotating the adjusting member 75 of the distance adjusting means 7 and rotating the male screw 76 screwed into the female screw 77 so that the distance C is adjusted. For example, when the distance C is narrowed, the ink rail body 4 is advanced by rotating the adjusting member 75 leftward. In contrast to this, when the distance C is widened, the ink rail body 4 is retreated by rotating the adjusting member 75 rightward. The second member 6 is advanced or retreated by these operations along the upper face of the pedestal 3. Accordingly, the distance C is adjusted by approaching and separating the ink supplying surface 40 of the ink rail body 4 from the outer circumferential surface of the fountain roller F.

The relation of arcs of the ink supplying surface 40 and the outer circumferential surface of the fountain roller F in the embodiment mode of this invention will next be explained. When the arc of a concave curved surface of the ink supplying surface 40 constructed by a concentric circle having a radius equal to or extremely slightly greater than the radius of the fountain roller F or an arc close to this concentric circle is moved on a straight line, which includes a center of the concentric circle, in a direction separated outside the arc as a convex curved surface of the fountain roller F by operating the distance adjusting means 7, the distance between the two arcs is largest on the straight line passing through the center of the concentric circle and is gradually reduced toward both ends of the arcs.

Conversely, when the arc of the concave curved surface of the ink supplying surface 40 is moved in a direction approaching the arc as the convex curved surface of the fountain roller F, no arc of the ink supplying surface 40 locally comes in contact with the arc as the convex curved surface of the fountain roller F although there is a case in which the arc of the ink supplying surface 40 comes in contact with the arc as the convex curved surface of the fountain roller F along an entire length of the arc of the ink supplying surface 40.

The upper face of the second member 6, i.e., the joining face having the ink supplying port 56 conforms to a plane including the rotation central line of the fountain roller F. Accordingly, the distance C along a longitudinal direction of the arc of the concave curved surface of the ink supplying surface 40 with respect to the outer circumferential surface of the fountain roller F is nipped and formed by the first member 5 and the second member 6. Further, the distance C becomes maximum at the opening portion of the ink supplying port 56 arranged oppositely to the rotation central line of the fountain roller F and becomes minimum in both end portions of the arc. The difference between the maximum and minimum distances is slight, but there is a great impact on thinly forming an ink film with respect to this difference. Namely, a suitably amount of ink intermittently supplied by an unillustrated ink pump is discharged and transferred to the outer circumferential surface of the fountain roller F from the ink supplying port 56 located in a portion of the maximum distance C slightly larger than the other portions in the longitudinal direction of the arc of the concave curved surface. In this case, while the ink discharged to a portion slightly larger in the distance C than the other portions is nipped between the outer circumferential surface of the fountain roller F and the ink supplying surface 40 as the fountain roller F is rotated in the direction of the arrow, the distance C is gradually reduced toward an end portion of the ink supplying surface 40 in its rotating direction. When the shearing action of this ink is taken into account, the thickness of the ink film is uniformly reduced and the ink is uniform and conveyed in the thin film so that the ink supply is extremely stabilized.

In the ink rail 1 in the embodiment mode of this invention, the ink supplying surface 40 is formed as a concave curved-surface having a relatively short arc. Therefore, it is very easy to set the suitable distance C between the convex curved surface of the outer circumferential surface of the fountain roller F and the concave curved surface of the ink supplying surface 40 in the operating position Y. The ink rail body 4 is attached to the upper face of the pedestal 3 horizontally arranged in the operating position Y, and a joining face having the ink supplying port 56 of this ink rail body 4 approximately conforms to a plane including the rotation central line of the fountain roller F so that an assembly adjustment is easily made. Further, the ink rail body 4 can be cheaply made light in weight since the ink rail body 4 is simple in shape and construction. Accordingly, the ink supplying surface 40 is easily moved near and separated from the outer circumferential surface of the fountain roller F. Therefore, there is almost no danger that the ink supplying surface 40 comes in contact with the outer circumferential surface of the fountain roller F in error during adjustments to the ink supplying surface 40. Accordingly, the suitable distance C can be very easily set by a worker even when the worker is not a skilled worker. Further, maintenance work is also easily performed.

Effects of the present invention are as follows.

(1) In comparison with the conventional case, a constructional member of the ink rail body is extremely simplified and an assembly work is easily made so that a burden on a worker is reduced and cost is greatly reduced.

(2) Ink supply can be stabilized and damaged paper can bet reduced.

(3) Printing quality can be improved.

(4) Adjustments of the distance between the outer circumferential surface of the fountain roller and the ink supplying surface of the ink rail body can be very easily made.

(5) Since the adjustments of the distance are easily made, the ink rail can be easily operated by a worker even when the worker is not a skilled worker. Accordingly, working efficiency of the ink rail is improved. Further, maintenance work is easily performed so that working efficiency is improved.

(6) Since damage to the outer circumferential surface of the fountain roller and the ink supplying surface of the ink rail body are prevented, it is not necessary to make repairs required by the damage.

(7) In the invention of claim 4, the assembly work of the ink rail body is made more easy so that the ink rail body is safely assembled for a short time even when the worker is not a skilled worker.

(8) In the invention of claim 5, the ink rail body is divided in its longitudinal direction so that the distance C can be adjusted for each divided unit. For example, when the ink rail body is divided into lengths each corresponding to one page unit of a newspaper, the distance C can be individually adjusted and set for every page.

What is claimed is:

1. An ink rail for a printing press capable of selecting an operating position in proximity to an outer circumferential surface of a fountain roller and a nonoperating position separated from the outer circumferential surface of the fountain roller;

the ink rail comprising:

an ink rail body formed by joining at least two members on a joining face so as to be divided, said body having a concave curved surface formed over the two members and having a plurality of ink supply ports, said ports having openings along one joining face on the concave curved surface;

a pedestal for supporting the ink rail body in a supporting plane parallel to the joining face having the ink supply ports;

a support member for supporting the pedestal, said support member configured to be angularly displaced; and a distance adjusting means arranged such that the ink rail body can be reciprocated along the supporting plane of the pedestal in a direction perpendicular to the longitudinal direction of the ink rail body;

said ink rail being constructed such that when in the operating position the joining face of the ink rail body approximately conforms to a plane which includes the rotational central line of the fountain roller, said ink rail further being constructed so that the concave curved surface of the ink rail body can be approached and separated from the outer circumferential surface of the fountain roller, allowing the distance therebetween to be adjusted.

2. The ink rail for the printing press as defined in claim 1, wherein the concave curved surface of the ink rail body has a size corresponding to a size from 1/12 to 1/6 times that of the outer circumferential surface of the fountain roller in its circumferential direction.

3. The ink rail for the printing press as defined in claim 1, wherein the supporting plane of the pedestal is horizontal.

4. The ink rail for the printing press as defined in claim 1, wherein the ink rail body is divided into a plurality of bodies, said plurality of bodies being divided in the longitudinal direction of the fountain roller, said plurality of bodies each having a separate distance adjusting means allowing the divided ink rail bodies to be individually adjusted.

5. The ink rail for the printing press as defined in claim 2, wherein the supporting plane of the pedestal is horizontal.

6. The ink rail for the printing press as defined in claim 2, wherein the ink rail body is divided into a plurality of bodies, said plurality of bodies being divided in the longitudinal direction of the fountain roller, said plurality of bodies each having a separate distance adjusting means allowing the divided ink rail bodies to be individually adjusted.

7. The ink rail for the printing press as defined in claim 3, wherein the ink rail body is divided into a plurality of bodies, said plurality of bodies being divided in the longitudinal direction of the fountain roller, said plurality of bodies each having a separate distance adjusting means allowing the divided ink rail bodies to be individually adjusted.

8. An ink rail for a printing press capable of selecting an operating position in proximity to an outer circumferential surface of a fountain roller and a nonoperating position separated from the outer circumferential surface of the fountain roller;

the ink rail comprising:

an ink rail body formed by joining at least two members approximately formed in the shape of a rectangular parallelepiped plate on a joining face so as to be divided, said body having a concave curved surface formed over the two members and having a plurality of ink supply ports, said ports having openings along one joining face on the concave curved surface;

a pedestal for supporting the ink rail body in a supporting plane parallel to the joining face having the ink supply ports;

a support member for supporting the pedestal, said support member configured to be angularly displaced; and a distance adjusting means arranged such that the ink rail body can be reciprocated along the supporting plane of the pedestal in a direction perpendicular to the longitudinal direction of the ink rail body;

said ink rail being constructed such that, when in the operating position the joining face of the ink rail body having the concave curved surface approximately conforms to a plane which includes the rotational central line of the fountain roller, said ink rail further being constructed so that the concave curved surface of the ink rail body can be approached and separated from the outer circumferential surface of the fountain roller, allowing the distance therebetween to be adjusted.

9. The ink rail for the printing press as defined in claim 8, wherein the concave curved surface of the ink rail body has a size corresponding to a size from 1/12 to 1/6 times that of the outer circumferential surface of the fountain roller in its circumferential direction.

10. The ink rail for the printing press as defined in claim 8, wherein the supporting plane of the pedestal is horizontal.

11. The ink rail for the printing press as defined in claim 8, wherein the ink rail body is divided into a plurality of bodies, said plurality of bodies being divided in the longitudinal direction of the fountain roller, said plurality of bodies each having a separate distance adjusting means allowing the divided ink rail bodies to be individually adjusted.

* * * * *